United States Patent [19]

Pennachio

[11] 4,232,866

[45] Nov. 11, 1980

[54] APPARATUS FOR PLAYING A GAME OF CHANCE

[76] Inventor: Attilio Pennachio, 14 Amber Cir., Las Vegas, Nev. 89106

[21] Appl. No.: 947,630

[22] Filed: Oct. 2, 1978

[51] Int. Cl.[3] ..... A63B 63/02; A63F 5/02; F41J 5/04

[52] U.S. Cl. ..... 273/374; 273/138 A; 273/274

[58] Field of Search ..... 273/138 A, 102.2 R, 273/102.2 A, 95 C, 102.1 F, 102.1 C, 105 R, 105 A, 123 A, 274, 142 R, 142 A, 142 B, 142 C, 142 D, 142 E, 142 F, 374; 35/60

[56] References Cited

U.S. PATENT DOCUMENTS

| | | | |
|---|---|---|---|
| 722,359 | 3/1903 | Fowler | 273/138 A |
| 1,892,113 | 12/1932 | Morgan | 273/102.2 R |
| 2,101,658 | 12/1937 | Szabo | 273/105 R |
| 3,366,415 | 1/1968 | Cooper | 35/60 UX |
| 3,384,375 | 5/1968 | Zifferblatt | 273/123 A |
| 3,667,757 | 6/1972 | Holmberg | 273/274 |
| 4,036,497 | 7/1977 | Garto et al. | 273/142 B X |
| 4,095,794 | 6/1978 | Garto et al. | 273/142 B X |

FOREIGN PATENT DOCUMENTS

| | | | |
|---|---|---|---|
| 1050119 | 8/1953 | France | 273/274 |
| 1105682 | 6/1955 | France | 273/274 |
| 949733 | 2/1964 | United Kingdom | 273/274 |

*Primary Examiner*—Richard C. Pinkham
*Assistant Examiner*—Arnold W. Kramer
*Attorney, Agent, or Firm*—Schwartz, Jeffery, Schwaab, Mack, Blumenthal & Koch

[57] ABSTRACT

An apparatus for playing a game of chance comprises a participator area for accommodating a plurality of players, a receptacle spaced from the participator area, a projectile which can be directed by a player from the participator area into the receptacle, and a display. The receptacle defines a plurality of separate regions to each of which is assigned one member of a set of possible play results, and the display has a plurality of display conditions corresponding respectively to the different members of the set of possible play results. Each region defined by the receptacle is provided with an electrical switch detector which is actuated by the projectile when it is in that region to place the electrically actuated display in the display condition corresponding to that member of the set of possible play results which is assigned to that region. A plurality of individual betting layouts is provided each including a plurality of betting zones each of which denotes a manner of winning and the payoff thereof, with the betting zones including zones for each member of the set of possible play results and zones for various groups or combinations of members of the set of play results.

11 Claims, 10 Drawing Figures

FIG. 6

| | | | | | | | | | | |
|---|---|---|---|---|---|---|---|---|---|---|
| 30 to 1 1-1 | | 30 to 1 2-2 | | 30 to 1 3-3 | ANY 2 OF KIND 4 to 1 | 30 to 1 4-4 | | 30 to 1 5-5 | | 30 to 1 6-6 |
| 30 to 1 | 15 to 1 | 10 to 1 | 7 to 1 | 5 to 1 | 4 to 1 | 5 to 1 | 7 to 1 | 10 to 1 | 15 to 1 | 30 to 1 |
| 2 | 3 | 4 | 5 | 6 | 7 | 8 | 9 | 10 | 11 | 12 |
| LOW GROUP | | | | | | HIGH GROUP | | | | |
| 1 to 1 2 · 3 · 4 · 5 · 6 | | | | | | 1 to 1 8 · 9 · 10 · 11 · 12 | | | | |

FIG. 7

| | | | | | |
|---|---|---|---|---|---|
| ODD 1 to 1 | | | EVEN 1 to 1 | | |
| 1 | 3 | 5 | 2 | 4 | 6 |
| 4 to 1 | 4 to 1 | 4 to 1 | 4 to 1 | 4 to 1 | 4 to 1 |
| 1 | 2 | 3 | 4 | 5 | 6 |
| LOW 1 to 1 | | | HIGH 1 to 1 | | |
| 1 | 2 | 3 | 4 | 5 | 6 |

FIG. 8

| | | | | | |
|---|---|---|---|---|---|
| DAILY DOUBLE 24 to 1 | | | | | |
| 4 to 1 | 4 to 1 | 4 to 1 | 4 to 1 | 4 to 1 | 4 to 1 |
| RED | BLUE | YELLOW | GREEN | BLACK | WHITE |

APPARATUS FOR PLAYING A GAME OF CHANCE

BACKGROUND AND SUMMARY OF THE INVENTION

This invention relates to games of chance. Games of chance employing one or more dice are well known. However, such games are subject to the disadvantage that during play a dishonest player may substitute a loaded die for one which is true and thereby cheat the people with whom he is playing.

According to the present invention, there is provided an apparatus for playing a game of chance comprising a participator area for accommodating a player of the game, a receptacle spaced from the participator area, a projectile which can be directed by such player from the participator area into the receptacle, and a display, the receptacle defining a plurality of separate regions to each of which is assigned one member of a set of possible play results and the display having a plurality of display conditions corresponding respectively to the different members of said set, each said region being provided with a detector which is adapted to be actuated by the projectile when the projectile is in that region to place the display in the display condition corresponding to that member of the set of possible results which is assigned to that region.

For better understanding of the invention, and to show how the same may be carried into effect, reference will now be made, by way of example, to the accompanying drawings in which.

Figure 3A:
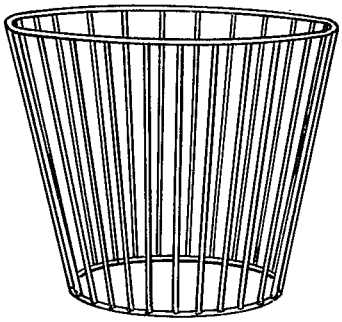
Figure 3B:
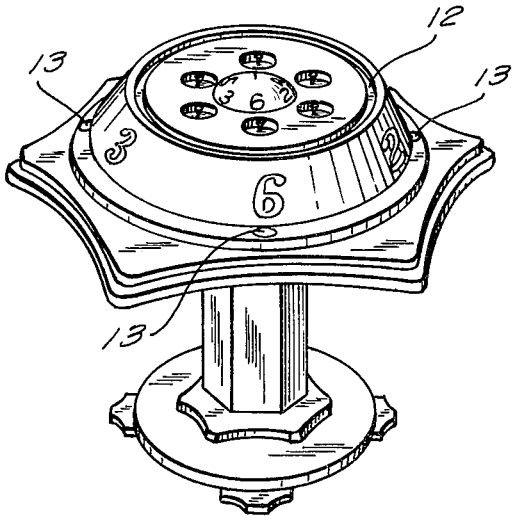

FIGS. 3*a* and 3*b* show perspective views of the two components of that part of the subject apparatus.

Figure 4:
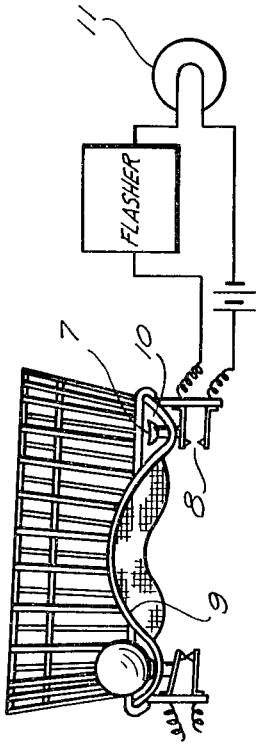
Figure 2:
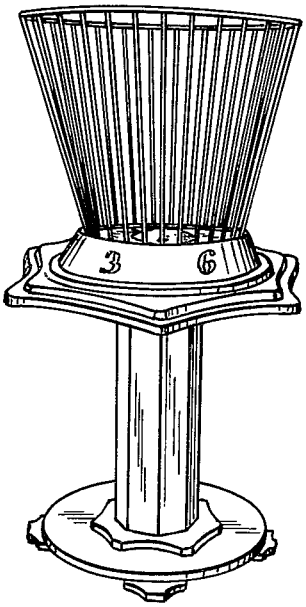
FIG. 2 shows a perspective view of a part of the subject apparatus.

FIG. 4 shows diagrammatically a vertical sectional view of that part of the subject apparatus which is shown in FIG. 2.

Figure 5:
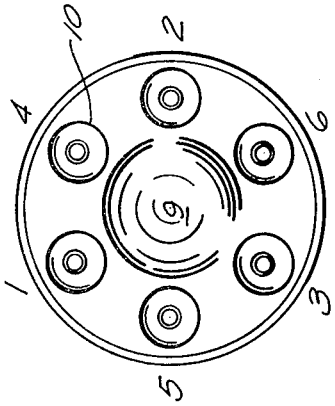

FIG. 5 shows diagrammatically a plan view of the component shown in FIG. 3*b*.

FIG. 6 shows a plan view of a further part of the subject apparatus.

FIG. 7 shows a plan view of part of a similar apparatus for playing a second game.

FIG. 8 shows a plan view of part of a similar apparatus for playing a third game.

Figure 1:
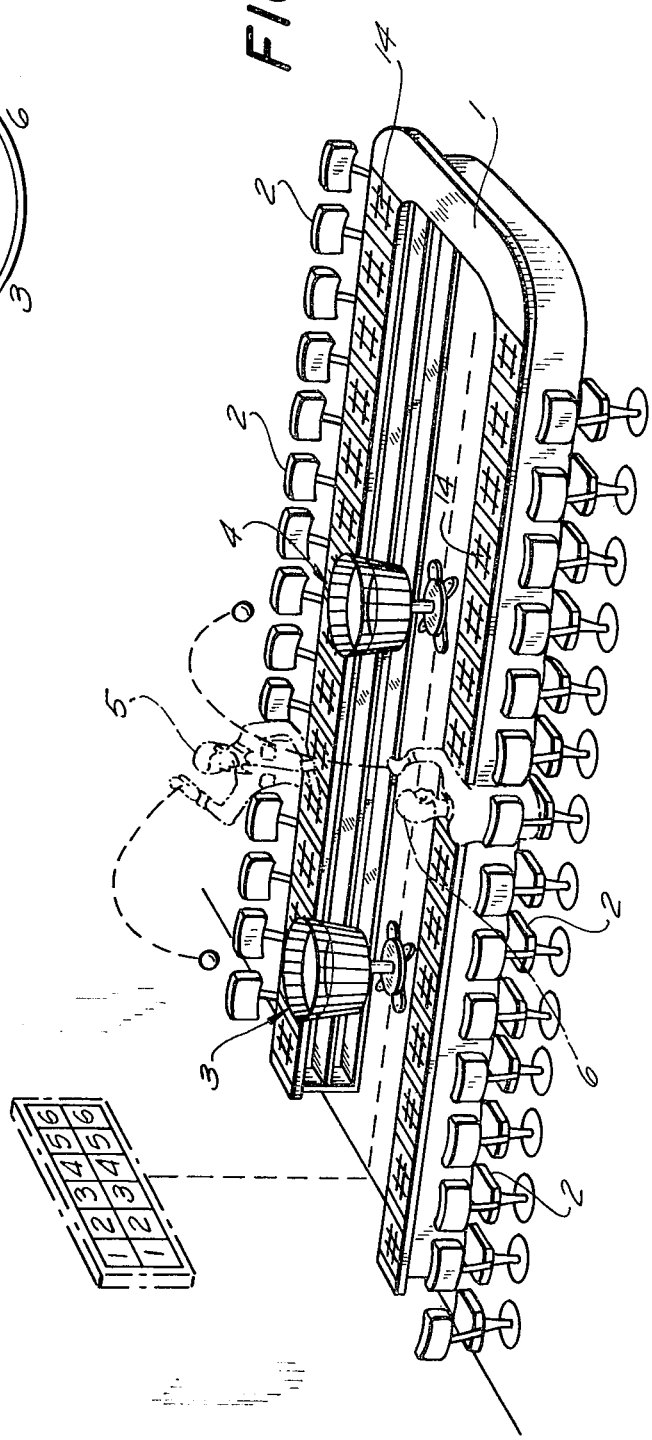
FIG. 1 shows a perspective view of the subject apparatus for playing a first game of chance.
Figure 9:
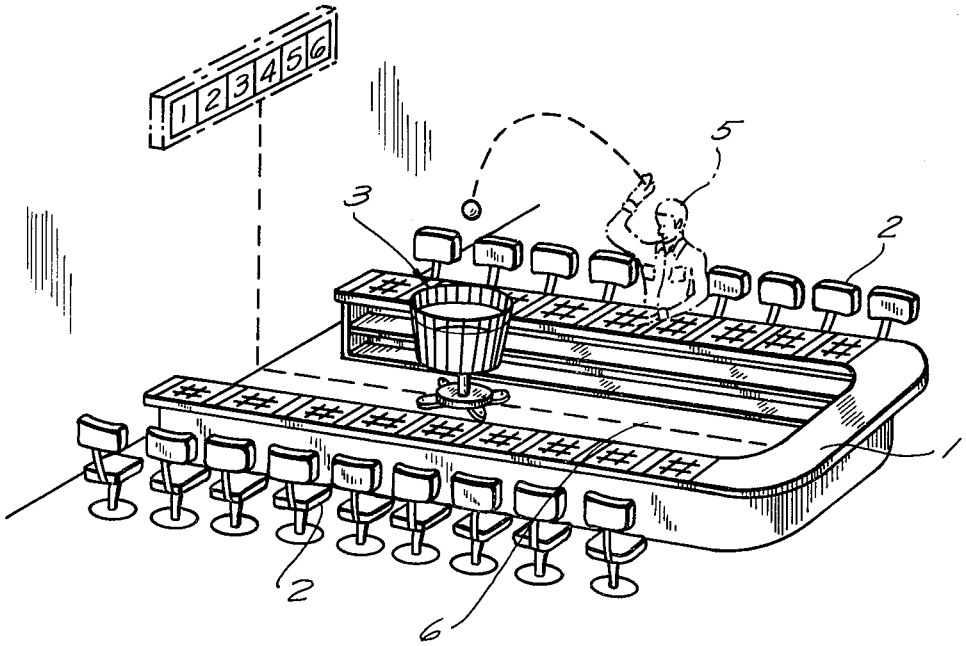

FIG. 9 shows a view, similar to FIG. 1, of the apparatus for playing the second or third game.

DETAILED DESCRIPTION OF THE PREFERRED EMBODIMENTS

FIG. 1 shows a barrier 1 which separates seats 2 from a pair of receptacle members, i.e., playing baskets 3 and 4. Barrier 1 is generally U-shaped in configuration having a pair of spaced apart, substantially parallel table members having baskets 3 and 4 disposed therebetween. In accordance with the subject invention, it is preferred that there be only two actual participators, for example as shown at 5 and 6, the remaining seats being available for occupation by spectators. Each of the participators is provided with a projectile, typically a rubber ball for throwing into one of the baskets. As a matter of convenience participator 5 throws his ball into the basket 3 while participator 6 throws his ball into the basket 4.

The construction of the baskets, each of which includes a wall portion and a generally circular base portion, can readily be seen from FIGS. 2, 3*a* and 3*b*. It will be understood that baskets 3 and 4 are identical in construction, and so only one basket is depicted in FIGS. 2, 3*a* and 3*b*. Preferably, the wall of each basket is generally frusto-conical in configuration, and is bounded at its lower and upper ends by smaller and larger steel hoops, respectively, which are joined by straight metal rods. The base may be made of wood and the smaller hoop is fitted in a circular groove 12 (FIG. 3*b*) formed in the base adjacent the outer periphery thereof. The base includes a substantially flat outer portion having six equally spaced recesses 10 whose centers lie on a circle which is concentric with the circular groove 12. FIG. 3*b* also shows three bubble spirit levels 13 to ensure that the base is level. The base also includes a central mound portion 9 which is encircled by the recesses 10. When a ball is thrown into a basket it bounces around therein, rebounding from the steel rods of the basket wall and being deflected by the mound 9, until it finally settles at random into one of the recesses 10. The mound 9 ensures that there is no "dead space" in which a ball thrown into the basket may settle and thus avoid rolling into one of the recesses.

In the bottom of each recess 10 is a switching plunger 7 (FIG. 4) arranged to cooperate with the contacts of a switch 8 to close the switch when a ball is received in that recess. The apparatus also comprises an illuminated display connected to the switches 8. The illuminated display is divided into twelve display areas in two rows of six. Each display area is provided with an electric lamp, for example as shown diagrammatically at 11 in FIG. 4. The six lamps of the upper row are connected respectively with the switches 8 of the basket 3 through respective flasher units while the six lamps of the lower row are similarly connected with the switches 8 of the basket 4. When a ball falls into one of the recesses 10 of the basket 3, the switch 8 associated with that recess is closed and the corresponding display area of the upper row is accordingly illuminated intermittently. Similarly, when a ball falls into a recess 10 of the basket 4, the switch 8 associated with that recess is closed and the corresponding display area of the lower row is accordingly illuminated intermittently.

In the case of the apparatus shown in FIG. 1, the six display areas respectively associated with the recesses of the basket 3 bear numerals 1 to 6, and the other six display areas are similarly numbered 1 to 6. Thus, the apparatus shown in FIG. 1 may be used to play a game similar to the dice game known as craps, but the two scores shown in the upper and lower rows respectively of the display are selected randomly and there is no possibility as in the dice game of a dishonest player cheating by using loaded dice.

The base of the basket 3 carries six labels adjacent respectively to the six recesses 10, and numbered "1" to "6" respectively corresponding to the numbering of the display areas respectively associated with the recesses. The "1" is opposite the "6", the "2" is opposite the "5", and the "3" is opposite the "4". The base of the basket 4 carries similar labels numbered in a manner corresponding to the numbering of the other six display areas. The players can readily see through the walls of the baskets and confirm that the numbers shown on the display correspond exactly to the numbers denoted by the labels. Any player or spectator who cannot see directly which recesses the two balls have fallen into can readily ascertain from the flashing display which recesses the balls have in fact fallen into.

For the purpose of gambling on the results of the game played with the apparatus shown in FIG. 1, there is provided on the barrier 1 in front of each seat 2 a staking plan or layout 14 as shown in FIG. 6. In a typical game the house may offer odds of 30 to 1 against the two scores having a selected equal value, and odds of 4 to 1 against the two scores having any equal value. The odds offered against any particular sum of the two scores may be between 4 to 1 (sum of 7) and 30 to 1 (sum of 2 or 12). For a sum anywhere in the range 2 to 6 or 8 to 12, the house may offer odds of 1 to 1. Each player places his chips on the region of his layout corresponding to the bet he wishes to make.

It will be clear that the layout shown in FIG. 6 provides four possible ways of winning in the case that the two scores have an equal value, two possible ways of winning if the sum of the scores is not 7 even if the scores do not have an equal value, and one way of winning if the sum of the scores is 7. It is believed that this number of options will be very popular with the gambling public.

The second game is similar to that played with the apparatus shown in FIG. 1, except that only one basket, one ball and one row of illuminated display areas are used, as shown in FIG. 9, and this second game is similar to throwing a single die. The odds offered by the house against a particular result occurring may be in accordance with the layout shown in FIG. 7.

The third game is a modification of the second game whereby instead of numerical scores the result of each play is expressed in terms of color. Referring to FIG. 8, there are 12 zones each of which denotes a manner of winning and the payoff for the respective manner of winning. More particularly, it will be noted that the 12 zones depicted in FIG. 8 are broken down into two groups. The first group comprises six zones, one for each of a different color, typically red, blue, yellow, green black and white. Each zone in said first group denotes predetermined payoff odds, such as 4 to 1, relating to the directing of the ball into one of the basket recesses associated with a particular color. The second group of zones labeled "Daily Double" in FIG. 8, comprises six zones, one for each of the above described colors. Each of the zones in the second group of zones denotes predetermined payoff odds (e.g. 24 to 1) relating to a successive first and second directing of the ball into one of the basket recesses, the payoff odds of the second group of zones being greater than that of said first group. For example, a player may place a bet on the red zone in the first group. If the ball tossed to the basket settles in the recess associated with the color red, the player gets back an initial amount of $5.00, the odds in the first group of zones having been set at 4 to 1. If the player wishes to bet the "Daily Double", he then must place his $5.00 in the red zone of the second group (i.e. the area in the Daily Double zone disposed immediately above the red zone in the first group of zones) wherein if upon a second successive toss to the basket the ball again settles into the recess associated with the color red, the player receives $25.00 back where the odds for the second group of zones has been set at 24 to 1.

It will be noted that all of the embodiments of the invention are used in conjunction with a group game in which many people may play at one time. However, there is only one decision or result effected for each play. It will be further noted that in the embodiment of the subject invention wherein two baskets are included, one player does not toss both balls, unless he is the only player.

It is to be understood that the invention is not limited to the specific constructions shown and described, as it will be apparent to those skilled in the art that changes may be made without departing from the principles of the invention as defined in the appended claims.

What is claimed is:

1. A gambling apparatus comprising a generally U-shaped table member having a pair of spaced apart substantially parallel table sections and a plurality of seats disposed along the outside portions of said sections for accommodating numerous participators; receptacle means disposed between said table sections, said receptacle means including a basket and a generally circular base member, said base member having formed therein six equally spaced circular recesses, the centers of said recesses defining a circle concentric with the periphery of the base member said base member further including a central closed mound encircled by said recesses, each of the recesses being associated with a number from 1 to 6, each of said numbers from 1 to 6 being indicated on the outside of the receptacle adjacent its associated recess, each of said numbers from 1 to 6 further being indicated on said mound portion adjacent its respective associated recess; a ball which may be directed by one of said participators to said receptacle for randomly falling into one of said recesses; means for leveling said base member to ensure the completely random entry of said ball into said one, or, at random, into any one of said recesses; a display having six display conditions corresponding respectively to the numbers from 1 to 6 associated with the base recesses; electrical control means for communicating the presence of the ball in one of the base recesses to said display for displaying the number from 1 to 6 corresponding to the respective ball containing recess; and a plurality of individual layouts, each of which is disposed on said table sections at each seat, each of said layouts including a plurality of separate betting zones each of which denotes a manner of winning and the payoff for the respective manner of winning, said betting zones including zones for each number and various groups or combinations of numbers.

2. The gambling apparatus of claim 1 in which each layout has 10 zones, one zone for each number from 1 to 6, a zone for the group of numbers 1, 3, and 5, a zone for the group of numbers 2, 4, and 6, a zone for the group of numbers 1, 2, and 3, and a zone for the group of numbers 4, 5, and 6.

3. The gambling apparatus of claim 1 wherein the upper surface of said base member is formed with an annular groove, said basket being generally frustroconical and having an annular bottom portion which releasably fits into said groove for retaining said basket on said base member.

4. The gambling apparatus of claim 1 wherein said basket is frustroconical in shape and is formed by upper and lower ends in the form of metal hoops, and metal rods extending between said hoops, said metal rods being spaced from each other so that the participators can visually detect the movement of the ball downwardly in the basket and around the area encircling the central mound before randomly dropping into one of said recesses.

5. The gambling apparatus of claim 1 further including second receptacle means identical to and spaced from said first recited receptacle means, and wherein said display has two sets of display conditions corresponding respectively to the two sets of play results associated with recesses of the base members of the respective receptacles; said electrical control means functioning to communicate the presence of a ball in one of the recesses of each base member to place the display in the display condition corresponding to the respective members of the two sets of possible play results associated with said ball-containing recesses; and a plurality of individual layouts each of which including a plurality of zones, each zone denoting a manner of winning and the payoff for the respective manner of winning, the number of zones being greater than the combined number of individual members of the sets of play results, some of said zones directly corresponding to the addition of individual members of said sets of play results, other of said zones corresponding to predetermined pairs of individual members of said set of play results, the remaining zones corresponding to predetermined characteristics of groups of members of said sets of play results whereby a participator may place a bet on a particular zone indicated on his individual layout such that he wins or loses depending on the combination of play results effected by the balls and the particular recesses in which the balls fall.

6. The gambling apparatus of claim 5 wherein said electrical control means comprises a switch for each recess, each of said switches including a plunger extending through an opening in the bottom of said recess, said plunger carrying at its bottom a contact adapted to engage a second, spaced contact when said ball falls into the recess and depresses the switch plunger, said contacts being connected to said display means.

7. A gambling apparatus comprising a table member having a plurality of seats disposed therealong for accommodating numerous participators; receptacle means disposed adjacent said table member, said receptacle means including a generally frustoconical basket and a base member on which said basket is mounted, means for leveling said base member, said base member including a substantially flat outer portion having disposed therein six equally spaced circular recesses, the centers of said recesses defining a circle concentric with the periphery of said base member, said base member further including a central mound portion encircled by said recesses, each of the recesses being associated with one member of a set of six possible play results, each member of the set being identified on said base adjacent its associated recess; a projectile which may be directed by one of said participators to said receptacle; display means for presenting a plurality of display conditions corresponding respectively to the different members of said set of play results; electrical control means for communicating the presence of said projectile in any one of the recesses to said display to place the display in the display condition corresponding to the member of the set of possible play results associated with said projectile-containing recess, said control means comprising a switch for each recess, each of said switches including a plunger extending through an opening in the bottom of said recess, said plunger carrying at its bottom a contact adapted to engage a second, spaced contact when the projectile falls into the recess and engages and depresses the switch plunger, said contacts being connected to said display means; and a plurality of individual layouts disposed on said table member at each seat, each of said layouts including a plurality of betting zones which denote a manner of winning and the payoff for the respective manner of winning, the number of zones being greater than the number of individual members of the set of play results.

8. The gambling apparatus of claim 7 wherein each of said recesses is associated with a different color, each of said six colors being indicated on the outside of the base member adjacent its associated recess, each of said colors further being indicated on said mound portion adjacent its respective associated recess; said projectile comprising a rubber ball which may be directed by one of said participators to said basket; said display means having six display conditions corresponding respectively to the six colors associated with the base recesses; said electrical control means placing the display in the display condition corresponding to the specific color associated with the recess into which said ball has dropped; each of said layouts including 12 zone portions broken down into two groups, the first group comprising six zones, one for each color, each of said zones denoting predetermined and equal payoff odds relating to a first directing of said rubber ball into one of said receptacle recesses, said second group comprising six zones, one for each color, each of said zones in said second group denoting predetermined payoff odds relating to a successive first and second directing of said rubber ball into the same one of said receptacle recesses, the payoff odds of said second group of zones being higher than that of said first group of zones, each of the payoff odds of said second group of zones being equal.

9. The gambling apparatus of claim 7 further including second receptacle means identical to and spaced from said first recited receptacle means, and wherein said display has two sets of display conditions corresponding respectively to the two sets of play results associated with recesses of the base members of the respective receptacles; said electrical control means functioning to communicate the presence of a projectile in one of the recesses of each base member to place the display in the display condition corresponding to the respective members of the two sets of possible play results associated with said projectile containing recesses; and a plurality of individual layouts each of which includes a plurality of zones, each zone denoting a manner of winning and the payoff for the respective manner of winning, the number of zones being greater than the combined number of individual members of the sets of play results, some of said zones directly corresponding to the addition of individual members of said sets of play results, others of said zones corresponding to predetermined pairs of individual members of said set of play results, the remaining zones corresponding to predetermined characteristics of groups of members of said sets of play results whereby a participator may place a bet on a particular zone indicated on his individual layout such that he wins or loses depending on the combination of play results effected by the particular recesses in which the projectiles fall.

10. The gambling apparatus of claim 7 wherein the upper surface of said base member is formed with an annular groove, said basket being generally frustroconical and having an annular bottom portion which releasably fits into said groove for retaining said basket on said base member.

11. The gambling apparatus of claim 7 wherein said basket is formed by upper and lower ends in the form of metal hoops, and metal rods extending between said hoops, said metal rods being spaced from each other so that the participators can visually detect the movement of the projectile downwardly in the basket and around the area encircling the central mound before randomly dropping into one of said recesses.

* * * * *